US006893509B2

(12) United States Patent
Sears et al.

(10) Patent No.: US 6,893,509 B2
(45) **Date of Patent: *May 17, 2005**

(54) METHOD OF CLEANING VESSELS IN A REFINERY

(75) Inventors: Sean E. Sears, Wichita, KS (US); Kevin L. Roberts, The Woodlands, TX (US)

(73) Assignee: Refined Technologies, Inc., Wichita, KS (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/447,441

(22) Filed: May 28, 2003

(65) Prior Publication Data

US 2004/0238006 A1 Dec. 2, 2004

(51) Int. Cl.[7] ..... B08B 9/00

(52) U.S. Cl. ..... 134/19; 134/22.1; 134/22.11; 134/22.12; 134/22.14; 134/22.15; 134/22.18; 134/22.19; 134/26; 134/27; 134/30; 134/31; 134/34; 134/35; 134/36; 134/37

(58) Field of Search ..... 134/19, 22.1, 22.11, 134/22.12, 22.14, 22.15, 22.18, 22.19, 26, 27, 30, 31, 34, 35, 36, 37

(56) References Cited

U.S. PATENT DOCUMENTS

| | | | | |
|---|---|---|---|---|
| 5,356,482 A | | 10/1994 | Mehta et al. | 134/22.1 |
| 5,389,156 A | * | 2/1995 | Mehta et al. | 134/10 |
| 5,425,814 A | | 6/1995 | Krajicek et al. | 134/22.1 |
| 6,017,492 A | * | 1/2000 | Hashimoto | 422/27 |
| 6,283,133 B1 | | 9/2001 | Furuta et al. | 134/22.1 |
| 2004/0102351 A1 | * | 5/2004 | Jansen et al. | 510/407 |

* cited by examiner

*Primary Examiner*—Sharidan Carrillo
(74) *Attorney, Agent, or Firm*—Shook, Hardy & Bacon L.L.P.

(57) ABSTRACT

Disclosed is a novel process for interior cleaning and by cleaning, removing noxious gas and/or restoring the operating efficiency of organically contaminated hydrocarbon processing equipment in a safe and effective manner and in a very short period of time, without a need to manually enter an unsafe environment and mechanically remove organic contaminants. Used is a formulation of non-aqueous, monocyclic saturated terpene mixed with a non-ionic surfactant package. The terpene-based chemical is injected into organically contaminated equipment using a novel process involving high-pressure steam to form a very effective cleaning vapor.

14 Claims, 2 Drawing Sheets

METHOD OF CLEANING VESSELS IN A REFINERY

CROSS-REFERENCE TO RELATED APPLICATIONS

None.

STATEMENT REGARDING FEDERALLY SPONSORED RESEARCH OR DEVELOPMENT

None.

BACKGROUND OF THE INVENTION

This invention relates to the field of processes for cleaning the internal surfaces of organically contaminated large, closed-vessel pieces of equipment (i.e., distillation vessels) and other support equipment (that can be isolated with steam and water either individually or collectively in closed "circuits") located in refineries and other petrochemical plants.

Common to the refining industry, a "turnaround" is the process of taking single or multiple distillation vessels off-line for maintenance and/or inspection. Multiple maintenance applications are performed during this time, including the replacement of valves, pipes, trays, spargers, packed sections, boilers, exchangers, and other components.

A "squat," which is a limited, less time-consuming version of a turnaround, usually involves taking only part of a pipestill section off-line (i.e., the vacuum vessel but not the atmospheric vessel).

A turnaround is performed for several reasons, some of which are mandated by the federal government and others determined by refinery operational needs. The government requires inspections on distillation vessels for safety reasons. In addition to mandated inspections, the refinery also may take a pipestill section, or a particular distillation vessel, off-line if it believes that the pipestill performance will be improved by modifying existing equipment or by performing planned or unplanned maintenance.

Thus, a turnaround is an infrequent opportunity for the refinery operator to enhance the performance of the vessel (s), thus increasing overall efficiency of the pipestill section. Processes in the refinery are intimately connected, thus deficiencies or enhancements in pipestills can significantly affect downstream applications and costs.

The timing of a turnaround, and the amount of time that the pipestill section or vessels are off-line, is very critical to the profitability of a refinery. As in other continuous process industries where demand for the product is also continuous, idle equipment causes an irreversible loss of revenue. In the case of a refinery, one day lost in production may cause several millions of dollars to be lost in revenue. Because of this, refineries will spend several months planning every step of the turnaround process in order that it is done quickly, safely, and efficiently. A reduction of days, or even hours, from the turnaround process gains the refinery significant marginal income.

During a turnaround, and before internal mechanical maintenance is performed of any kind, a cleaning must take place which frees all the internal surfaces of the refinery components from contaminants. These internal surfaces may include the walls of the vessel cylinder, the tops and bottoms of trays, packing sections (loose or fixed), spargers, pump-around piping, and especially the bottom third of the vessel. The bottom section is typically very difficult to clean since it is the area that produces the heavier factions of hydrocarbons. The quicker this cleaning is accomplished, the sooner industry-cleanliness standards will have been met. Until then, however, workers will not be permitted entry into the vessel.

The contaminants removed would include any hydrocarbon that is found in crude oil. These hydrocarbons will vary in size, length, molecular weight and structure. The industry refers to these different structures as Light End, Medium and Heavy. Light Ends would be cuts like methane, propane, ethane, and the like. Medium cuts would include kerosene, gasoline, and diesel, among others. Heavy cuts would include lubricants, waxes and asphalt.

There are several reasons why distillation vessels and other supporting equipment must be effectively cleaned before interior maintenance is performed.

A first reason involves the removal of dangerous fumes. If the hydrocarbons are not effectively cleaned from the vessel, an accumulation of by-product fumes (i.e., $H_2S$ gas) will remain therein. These gases are deadly to humans—especially when that exposure occurs within a confined space. By federal law, refinery operators must reduce hydrocarbon levels below industry maximums before allowing people to enter the vessel to perform work. If levels are not low enough upon reading, the vessel must either be recleaned or vented to the atmosphere for hours or days.

A second reason involves reduction of fire hazards. It is not uncommon for welders to accidentally set vessels on fire during mechanical work if the vessels are not cleaned thoroughly. This level of cleanliness is especially important in the packed sections of a vessel which may trap significant hydrocarbons, causing high LEL readings upon entry if not properly cleaned. Therefore, the refinery components must be thoroughly cleaned to prevent the danger of fire.

A third reason involves enabling more effective visual inspections. It takes operators and federal inspectors longer to inspect a vessel, if that vessel is not properly cleaned. This is because inspectors are looking for fatigue or cracks in the trays or walls along with other potential signs of failure. If the potential exists that defects may be hidden by unremoved contaminants, it will take the searcher longer to determine whether or not such defects exist. Thus, the process is made more time-consuming and costly.

A fourth reason involves overall safety. Quite simply, the potential for slips, falls and other mishaps in the vessel are reduced when the metal is freed from oils, waxes and greases. Therefore, thorough cleaning reduces the likelihood of injury to workers.

A fifth reason involves process efficiency. When a process vessel is contaminated, pressure drops occur which limit the process throughput or output rates. When the contaminant is removed, flow rates may be increased, with a subsequent improvement in operating efficiency.

There are several known methods for cleaning pressurized vessels in petroleum refineries known in the prior art.

One such method involves basic steam cleaning. With this method, the refinery first takes the pipestill off-line. Reduced crude (gas oil) is then circulated through the vessel. Reduced crude or gas oil is primarily medium to light end hydrocarbons similar to kerosene. The reduced crude physically displaces solid materials from the vessel, and takes approximately 48 hours to complete. After the reduced crude wash, the vessel is completely emptied. High-pressure steam is then piped into the vessel. While simple and relatively inexpensive, the cleaning performance of high-pressure steam is very poor. Refineries will steam a vessel in this manner for as long as five days. After the steaming process, the vessel must be tested for hydrocarbon gas. Workers can not enter the vessel until the hydrocarbon gas levels have been reduced to a safe level. By itself, the steam process will not reduce the hydrocarbon gas. Therefore, the vessel is usually opened to the atmosphere until the hydrocarbon gas has volatilized and moved out of the vessel. This airing out process may take as long as two days before entry is gained to the vessel. Once the hydrocarbon gas level has been reduced to an acceptable level, a cleaning crew may be sent in. The cleaning crew usually comprises four to six workers. These workers, once inside the vessel, physically mop or scrape components until they are clean. This process may take the crew an average of four to six days. Once the vessel has been cleaned, welding, maintenance, and repair can begin.

Another method incorporates liquid cleaning with a caustic solution. Caustic solution cleaning begins like the basic steam cleaning method—with a reduced crude wash. After the reduced crude wash, caustic or high-pH chemicals are circulated through the vessel. The caustic chemicals are usually diluted with water and circulated through the vessel in the liquid phase. Circulating the caustic chemicals in the liquid phase requires a high volume of liquid to reach the entire surface area in the vessel. The liquid circulation process will normally last 48 hours. After the caustic chemical wash, the vessel is drained. Effluent collected from the caustic chemical wash must be collected and treated. Due to the high pH of the caustic chemical, effluent generated during the caustic wash must be neutralized with an acid to neutralize the pH before the significant quantities of effluent are sent to a wastewater-treatment plant for processing. Additional processing may be required if the caustic chemicals contain phosphates, silicates, or other chelating agents that can interfere with the waste-treatment process. Just like the basic steam cleaning method, the vessel is opened to the atmosphere for up to two days to volatilize out any remaining hydrocarbons before crews may enter to mop and scrape the interior surfaces.

Yet another method involves an organic solvent wash. This method, like the first two, begins with a reduced crude wash. Next, organic solvents are circulated through the vessel from top to bottom. Although these organic solvents may satisfactorily remove oils, they do not have the solvency strength necessary to thoroughly clean the vessels while in a liquid phase. Solvent circulation can last as long as 24–48 hours. After the liquid phase cleaning, a water rinse is used to remove organic contamination from the vessel. Since organics by nature are not water soluble, rinsing with water is time-consuming, inefficient, and very difficult. Additionally, it is extremely difficult to determine whether these potentially harmful organics have been completely removed by the rinse process. Just like with the earlier methods, the vessel is exposed to the atmosphere to volatize out any remaining hydrocarbons, and a cleaning crew is then sent into the vessel to mop and scrape. Many times, failure to clean all surfaces results in high noxious gas readings (H2S, Benzene etc.) causing workers to don "fresh air" breathing apparatus. This apparatus slows down the turnaround and subjects workers to the hazardous environment. Yet another, and perhaps the greatest disadvantage of cleaning distillation vessels using a liquid phase procedure is the inability to get the underneath side of the equipment clean. Distillation trays, packed sections, and pall rings need to be cleaned on all sides before hot work can begin. Because these areas cannot be reached by the organic solvent wash, and because contaminants on these surfaces raise the possibility of noxious gas creation, and preclude inspection and maintenance activities the refiner is required to manually clean the tray bottoms, a process that is difficult, time consuming and dangerous.

In summary, each of these prior art methods incorporate individual processes that are particularly time-consuming and largely ineffective. What's more, additional time is consumed by the requirement that the vessel be exposed to the atmosphere to remove harmful gas and then manually cleaned to remove contamination.

The present invention overcomes these disadvantages in the prior art methods by introducing a cleaning agent in small specifically regulated quantities into vessels (and/or supporting equipment) by the use of steam. The steam volatilizes the cleaning agent and quickly dissolves the organic residues from the vessel. The cleaning agent used is comprised of a terpene and surfactant.

Terpenes have been used in refineries before. A liquid-steam method using terpenes is disclosed in U.S. Pat. No. 5,356,482 ("the '482"). The methods disclosed in the '482, however, are much different than those disclosed here. First, the '482 discloses the use of terpenes to detoxify the insides of a component in a refinery to remove dangerous and explosive gases. The method of the present invention, however, is directed to a technique of cleaning (or degreasing) the metal surfaces inside the refinery component—cleaning that component of essentially all contaminants on its interior surfaces. Not just degassing or masking/coating remaining hydrocarbons.

Second, the '482 suggests the use of recirculation for cleaning larger vessels such as fractionation towers, whereas circulation is specifically not a part of the process of the present invention. In fact, recirculation, if employed as part of the present invention would simply recontaminate many internal surfaces within the tower. The process of the present invention has been shown to work well for degassing and cleaning without circulation.

Third, the '482 methods further require the vessel to be completely sealed under pressure and to cool—a technique that has been known to occasionally cause catastrophic collapse. After a first cleaning, the insides of the vessel are sampled for the presence of noxious gas. The process of cleaning-cooling-sampling is repeated until a particular sampling shows that noxious gas is reduced to acceptable levels. This iterative process is unnecessarily time consuming and potentially hazardous to the people performing the process by comparison to the present invention.

The process of the present invention, however, requires instead that the equipment be ventilated either to atmosphere or to subsequent equipment in the refinery as part of a cleaning "circuit." Additionally, contaminant is removed through the addition of a predefined amount of chemical rather than by sampling and process repetition.

SUMMARY OF THE INVENTION

The present invention is a method of cleaning a contaminated vessel, comprising the steps of (i) providing a steam source; (ii) providing a surfactant source; (iii) providing an organic solvent source; (iv) delivering steam from said steam source to said vessel; (v) introducing the organic solvent from the organic solvent source into the steam delivered; (vi) introducing a surfactant from said surfactant source into the steam delivered; (vii) removing vaporous effluent from said vessel while the steam, organic solvent, and surfactant are being delivered to form a circuit; (viii) draining the vessel, and (iv) rinsing the vessel.

More specifically, the process involves taking the equipment to be cleaned out of service by blocking (or blinding) it in, injecting a terpene and a surfactant package into high-pressure steam, and introducing the steam and chemistry mixture into the equipment to clean its inside surfaces. The described process is particularly well-suited to cleaning large surface areas with relatively little cleaning fluid. The equipment used to introduce it includes a system of pumps, T-fittings and injector nozzles needed to vaporize and accurately control the volumetric ratios of chemical vapor and steam. The cleaner injected into the steam ideally includes a formulation including a monocyclic saturated terpene mixed with a non-ionic surfactant package.

Once the cleaner has been administered, the vessel is allowed to dwell, with steam continually delivered there through. After this dwell cycle, the vessel is drained and then rinsed. The rinse cycle of the present invention is especially unique, in that the presence of cleaner within the vessel may be detected by simply examining the rinse water. If the water is milky in appearance, then cleaner is still present in the vessel, and entry should not be made therein. However, if the water is clear, workers are then able to enter the vessel to inspect or perform maintenance.

The process may be used to clean towers; heat exchangers; drums; lines; pumps; reactors; overhead receivers; slurry systems; and charcoal, sand or clay filters—virtually any vessel or other support equipment in the refinery that can be isolated and accessed by steam and water may be cleaned using these same basic concepts.

BRIEF DESCRIPTION OF THE DRAWING

The present invention is described in detail below with reference to the attached drawing figures, wherein.

DETAILED DESCRIPTION OF THE INVENTION

Figure 1:
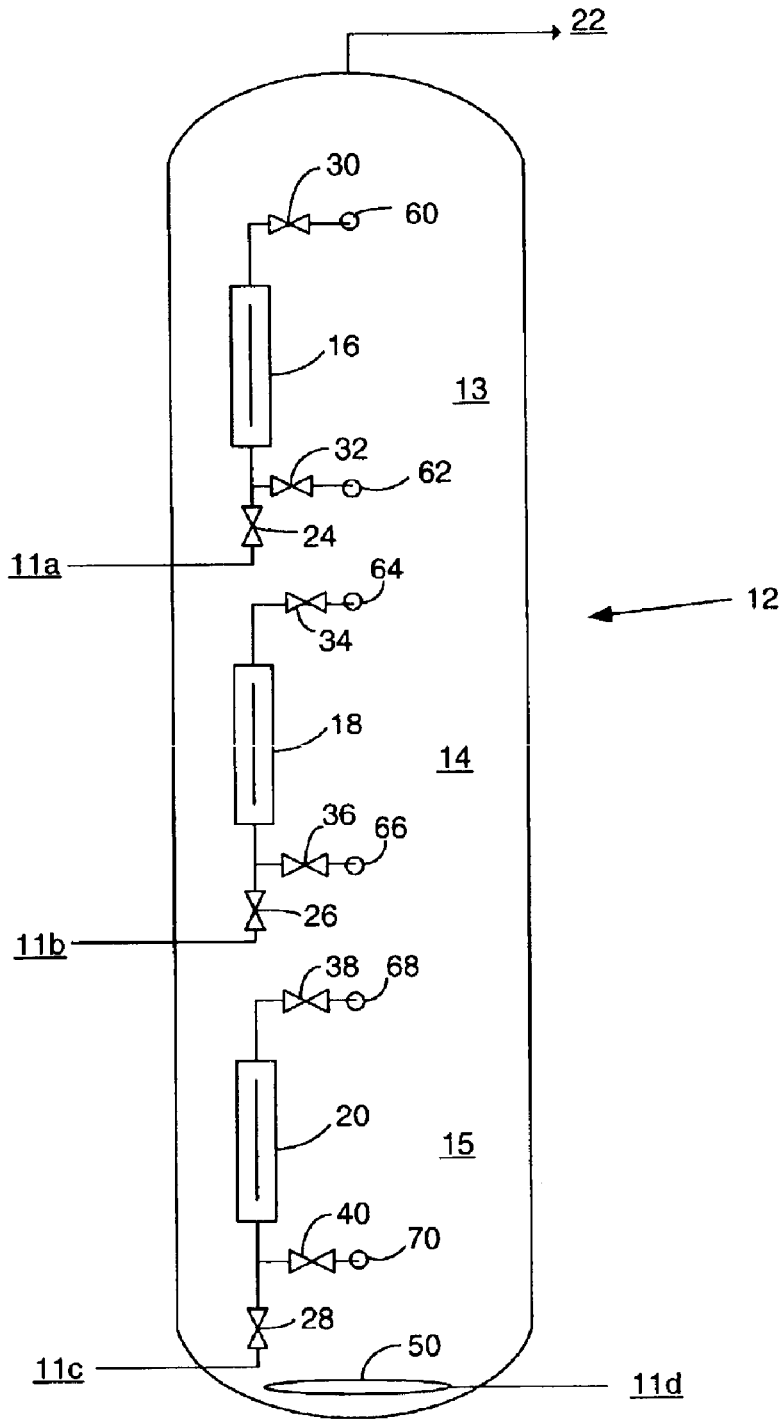
FIG. 1 is a schematic diagram showing the injection equipment of the present invention.

The present invention solves the problems present in the prior art methods.

Less cost and more regular cleaning is possible because the present invention enables vessels and supporting equipment to be cleaned much more quickly than with the prior art methods which required that the vessel be exposed to the atmosphere and then manually cleaned. Because the equipment is cleaned much more quickly, the refinery is able to boost efficiency by minimizing downtime during cleaning.

In addition to improving overall efficiency, the present invention is also more environmentally friendly. First, before the present invention, refineries would continue to operate heavily fouled equipment in order to avoid the expense of a complete shut-down. The selective cleaning methods of the present invention avoid this dilemma—by enabling more frequent cleanings. Also, because the equipment is cleaned more often, it operates more efficiently. This reduces the amount of heat/energy required to operate the refinery. The generation of heat/energy required to operate the refinery creates the emissions of toxins such as carbon dioxide, sulfur dioxide, nitrogen oxide and other gases.

An additional benefit of the process of the present invention is its ability to clean large-closed vessels using a volume of cleaning agent that is less than 1 percent of the volume of the vessel. This reduces the cost of cleaner required, as well as minimizing the quantity of materials that must be processed afterwards for environmental reasons.

The process also cleans the internal surfaces of the vessel much more completely than was possible with the prior art methods. The current process cleans packed sections extremely well due to the high Kb value (Kauri Butanol value—a measure of solvency strength) of the cleaner used, and the method applied. This is a great advantage to the industry because it removes the hydrocarbons (fuel source) thus reducing the risk of pack section fires during hot work inside the vessel. By cleaning more thoroughly, the disclosed process eliminates the need for four to six days of manual scraping and the mopping of residues by refinery-employed or contracted employees.

Yet another advantage over the prior art is that there is no need for exposing the vessel to the atmosphere to volatize out any remaining hydrocarbons after administering the cleaner. This prior art step—which usually costs the refinery two days of downtime—is eliminated by the process of the present invention.

The combination of a unique cleaning agent and the process by which it is used makes this cleaning method for distillation, or other vessels, fast and effective. It may be used to clean atmospheric or vacuum-type crude distillation vessels along with any other refinery equipment that can be isolated and accessed by steam and water.

The present invention accomplishes the above described benefits using a naturally occurring organic solvent as the cleaning agent. The cleaning agent is injected directly into high-pressure steam lines already present in the refinery's system. Once injected, the cleaning agent is vaporized and allowed to clean all surfaces inside the equipment in a very short period of time (6–12 hours on average).

The cleaning agent utilizes a surfactant package that improves the detergency (solvency strength) and allows the formula to be water-soluble. When the cleaning agent mixes with water it forms a stable macro-emulsion and takes on the appearance of milk. Because the water appears milky when cleaner is present, and clear when cleaner is not present, the appearance of the cleaning agent, combined with water, gives a visual rinse check to the operator. Once the rinse water is clear, the operator knows all of the cleaning agent has been rinsed out of the vessel.

The cleaning agent used has two ingredients. The first is a terpene. The term "terpenes" is traditionally applied to cyclic hydrocarbons having structures with empirical formula $C_{10}H_{16}$ which occur in the essential oils of plants. Knowledge of the chemistry of the terpene field has developed and compounds related both chemically and biogenetically to the $C_{10}H_{16}$ carbons have been identified. Some natural products have been synthesized and other synthetic compounds resemble known terpene structures. Consequently, the term "terpenes" may now be understood to include not only the numerous $C_{10}H_{16}$ hydrocarbons but also their hydrogenated derivatives and other hydrocarbons possessing similar fundamental chemical structures. These hydrocarbons may be acyclic or cyclic, simple or complex, and of natural or synthetic origin. The cyclic terpene hydrocarbons may be classified as monocyclic, bicyclic, or tricyclic. Many of their carbon skeletons have been shown to consist of multiples of the isoprene nucleus, $C_5H_8$.

Generally, the terpene selected could be acyclic, bicyclic, or tricyclic. Examples of acyclic terpenes that might be used are geraniolene, myrcene, dihydromycene, ocimene, and allo-ocimene. Examples of monocyclic terpenes that might be used are ρ-menthane; carvomethene, methene, dihydroterpinolene; dihydrodipentene; α-terpinene; γ-terpinene; α-phellandrene; pseudolimonene; limonene; d-limonene; l-limonene; d,l-limonene; isolimonene; terpinolene; isoterpinolene; β-phellandrene; β-terpinene; cyclogeraniolane; pyronane; α-cyclogeraniolene; β-cyclogeraniolene; γ-cyclogeraniolene; methyl-γ-pyronene; 1-ethyl-5 5-dimethyl-1,3-cyclohexadiene; 2-ethyl-6,6-dimethyl-1,3-cyclohexadiene; 2-ρ-menthene 1(7)-ρ-methadiene; 3,8-ρ-menthene; 2,4-ρ-menthadiene; 2,5-ρ-menthadiene; 1(7),4 (8)-ρ-methadiene; 3,8-ρ-menthadiene; 1,2,3,5-tetramethyl-1-3-cyclohexadiene; 1,2,4,6-tetramethyl-1,3-cyclohexadiene; 1,6,6-trimethylcyclohexene and 1,1-dimethylcyclohexane. Examples of bicyclic terpenes that might be used are norsabinane; northujene; 5-isopropylbicyclohex-2-ene; thujane; β-thujene; α-thujene; sabinene; 3,7-thujadiene; norcarane; 2-norcarene; 3-norcarene; 2-4-norcaradiene; carane; 2-carene; 3-carene; β-carene; nonpinane; 2-norpinene; apopinane; apopinene; orthodene; norpadiene; homopinene; pinane; 2-pinene; 3-pinene; β-pinene; verbenene; homoverbanene; 4-methylene-2-pinene; norcamphane; apocamphane; campane; α-fenchane; α-fenchene; sartenane; santane; norcamphene; camphenilene; fenchane; isocamphane; β-fenchane; camphene; β-fenchane; 2-norbornene; apobornylene; bornylene; 2,7,7-trimethyl-2-norbornene; santene; 1,2,3,-trimethyl-2-norbornene; isocamphodiene; camphenilene; isofenchene and 2,5,-trimethyl-2-norbornene.

The terpene normally used, and most preferred as the first ingredient in the cleaning agent of the present invention is a monocyclic saturated terpene that is rich in para-menthane ($C_{10}H_{20}$). Para-menthane has a molecular weight of 140.268. This active ingredient includes both the cis- and trans-isomers. Common and approved synonyms for para-menthane include: 1-methyl-4-(1-methylethyl)-cyclohexane and 1-isopropyl-4-methylcyclohexane. Para-menthane is all natural, readily biodegradable by EPA methods, and non-toxic by OSHA standards. Monocyclic saturated terpenes, however, are not the only compounds that may be used as the active ingredient of the cleaning agent. Other naturally occurring terpenes, such as (i) monocyclic unsaturated isoprenoids such as d-limonene ($C_{10}H_{16}$), (ii) bicyclic pine terpenes such as -pinene & -pinene, or (iii) any combination of monocyclic and bicyclic terpenes could also be used.

A second ingredient in the cleaning agent is an additive. The additive of the present invention is a nonionic surfactant package which enhances detergency, wetting, and rinsing. The first major constituent of the surfactant package includes a linear alcohol ethoxylate ($C_{12}$–$C_{15}$) with an ethoxylated propoxylated end cap. This linear alcohol ethoxylate greatly enhances the detergency or cleaning power of the cleaning agent formulation. Linear alcohol ethoxylates are also more environmentally friendly than more traditional surfactants. They exhibit good biodegradation and aquatic toxicity properties. Another major constituent of the cleaning agent surfactant package is a fatty alkanolamide primarily consisting of amides and tall oil fatty N,N-bis(hydroxyethyl). This fatty alkanolamide primarily aids in rinsing, oil solubility, and wetting. The combination in the proper ratios of these two classes of surfactants achieves the desired enhancements of the cleaning agent formulation. The following nonionic surfactants with an HLB range of 6.0–10.5 are also acceptable as an additive package which may include but are not limited to (i) nonylphenol polyethoxylates, (ii) straight chain linear alcohol ethoxylates, (iii) linear alcohol ethoxylates with block copolymers of ethylene and propylene oxide, (iv) oleamide DEA, or (v) diethanolamine. Of course, one skilled in the art would recognize that other additives could be used which would still fall within the scope of the invention.

Formulation of the cleaning agent of the present invention is effective at any of the following composition ranges by using a combination of the acceptable chemistries from above:

| Component | Range (by weight) |
|---|---|
| Terpene | 50%–95% |
| Additive Package | 5%–50% |

Formulation of the cleaning agent of the present invention has been found to be most effective when in the following ranges:

| Component | Range (by weight) |
|---|---|
| Terpene | 85%–88% |
| Additive Package | 12%–15% |

Calculating a ratio based on the percentages immediately above, we see that the ratio by weight of the additive surfactants to organic solvents (terpenes) of said cleaning agent should be between 0.136 and 0.176 in order to obtain the best results. It is, however, still within the scope of the invention to use ratios outside the 0.136–0.176 range. It is important to note that water is not present in any formulation of the present method.

The combination of the unique cleaning agent formulation is used according to the following procedures. First, the vessel desired to be cleaned is emptied of free flowing heavy organic solids. It may then be subjected to a reduced crude wash, where medium or light end hydrocarbons are circulated through the vessel to physically displace solid materials from the vessel. Such a wash is only optional, however. Regardless, the vessel is completely emptied by draining it and pumping it out using standard shut down procedures that will be known to those skilled in the art.

Next, the vessel is blocked or blinded in by closing off all incoming and outgoing fluid valves in a manner known to those skilled in the art.

FIG. 1 helps illustrate how this procedure would be accomplished for a typical main fractionation column (tower). It is important to note, that although a fractionation column has been chosen for demonstrative purposes, the herein disclosed process works equally well for numerous other equipment found in a refinery. For example, Applicant's processes have been found to work equally well in the cleaning of other kinds of towers, such as distillation, contact, extraction, and absorber-strippers as well. These methods have worked equally well in other refinery equipment such as drums; lines; pumps; reactors; overhead receivers; slurry systems; and charcoal, sand or clay filters. Virtually any vessel in a refinery that can be isolated with steam and water may be cleaned using these same basic concepts. It is important to note that the term "vessel," as used in this application, is intended to mean any hollow container. Not any specific type of vessel. The definition includes both vessels in which materials are processed, stored, or transferred. Therefore, though the vessel selected for illustrating these methods is a fractionation tower, one skilled in the art will immediately understand that the scope of the invention is not intended to be limited to cleaning towers or any of the other equipment specifically identified herein.

Referring to FIG. 1, the typical fractionation column 12 comprises upper 13, middle 14, and lower 15 portions. Typically, a number of level gauges appear on the outside of the column. These enable the user to determine fluid levels within the column. In the column 12 shown here, three such level gauges, 16, 18, and 20, are provided. Each gauge is tapped in to the column at particular points of entry. Gauge 16 is tapped in at points 60 and 62. Gauge 18 at points 64 and 66. Gauge 20 at points 68 and 70. Flow into each of gauges 16, 18, and 20 is controlled using gate valves 30 and 32, 34 and 36, and 38 and 40, respectively. During normal operation of tower 12, gate valves 30, 32, 34, 36, 38, and 40 will be open to enable the gauges to function. Each of these gauges 16, 18 and 20, however, also have associated gate valves 24, 26, and 28. Associated gate valves 24, 26, and 28, when open, will provide access to the inside of the column through the gauges at points 60, 62, 64, 66, 68, and 70.

Access to the inside of column 12 is also available through a steam ring 50. Steam rings are typically found at the bottoms of many tower structures. With the particular arrangement disclosed here, the fluid access to the inside of the vessel is obtained though gates 24, 26, 28, and steam ring 50. However, it is important to note that vessels and other equipment also typically have other means of access (e.g., bleeder connections) which may work equally as well. The only critical need is that some form of obtaining fluid access is selected. One skilled in the art will recognize that numerous means of access could be used equally well, and that the scope of the invention is not intended to be limited to those specifically identified herein.

The process of the present invention makes use of these points of access in order to introduce steam containing a cleaning agent. However steam and cleaner are introduced, the vessel is vented at the top through a vent 22. Vent 22 ideally leads to the flare (not pictured) so that effluent may be properly disposed of during the process yet to be fully disclosed. It could, however, lead to the atmosphere, or to be vented through interconnected vessels.

Steam is tapped into the vessel at associated gate valves 24, 26, and 28 and also at steam ring 50 in a manner known to those skilled in the art. All the gate valves shown 24, 26, 28, 30, 32, 34, 36, 38, and 40 should be open. The steam provided at each of these separate access points is normally obtained from preexisting steam lines in the plant. The lines selected should have steam temperatures of at least 330 degrees Fahrenheit. Ideally, the line temperatures should be between about 350 to 450 degrees Fahrenheit. The typical 150 psig refinery steam line will work effectively, however, super-heated 40 psig steam lines, which deliver steam at temperatures in excess of 400 degrees Fahrenheit, may be used as well. The injected steam increases internal temperatures within the vessel.

Later in the process, cleaner will be administered into the column along with the steam at the same access points. The introduction of the cleaning agent is made possible by joining the source of refinery steam sources with corresponding sources of cleaner.

Figure 2:
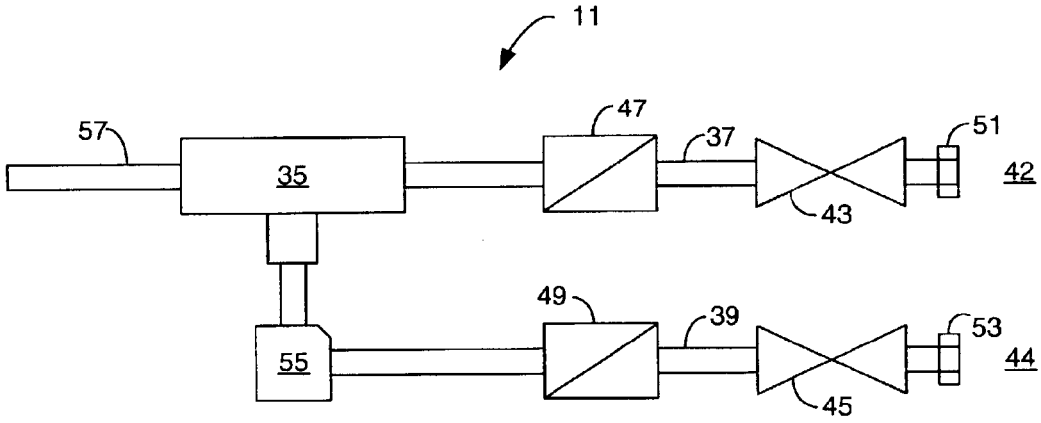
FIG. 2 is a schematic diagram showing the administration of the cleaning process of the present invention to a vessel.

The administration of both steam and cleaner are accomplished using an administrator 11. The details regarding administrator 11 of the present invention are shown in FIG. 2. FIG. 2 discloses that steam 40 and cleaner 44 sources joined at a T-junction 35. Such T-junctions are standard plumbing, and acceptable embodiments are readily available to one skilled in the art. The refinery steam hose (not shown) selected as steam source 40 for use in the cleaning process is attached to steam conduit using a standard connector 51. Conduit 37 transmits the steam under pressure to a first side of junction 35. Between steam source 40 and junction 35 on conduit 37, a steam-gate valve 43 serves to either open or shut off the source of steam 40 after the hose is attached. Immediately downstream, a check valve 47 allows flow in the downstream direction only. This prevents back flow of cleaning chemical or effluent into the steam source.

Interposed on conduit 39 between cleaner source 44 and junction 35 are cleaner-gate valve 45 and check valve 49. Gate valve 45 is used to either allow or shut off the flow of cleaner from source 44. Check valve 49 allows flow in the downstream only to prevent the back flow of steam into the cleaner container. A standard elbow 55 is used to converge conduit 37 and 39 into junction 35. After steam and cleaner conduits, 37 and 39 respectively, meet up at junction 35, their collective flows are converged into a common line 57, shown in FIG. 2. Common line 57 is used to tap the administrator into wherever the steam and cleaner is needed.

This valved-T-junction arrangement enables the user to optionally: (i) introduce neither steam, nor cleaner; (ii) introduce only steam; or (iii) introduce steam and vaporized cleaner into a desired access point on the column. Cleaner is administered using a pneumatic barrel pump (not pictured) which is attached to a connector 53 on cleaner conduit 39. The cleaner is initially in liquid form, however, when it reaches T-fitting 35, it is immediately aspirated and vaporized and administered to the vessel in a vaporous form.

Administrators identical to the one discussed in detail above are used at 11*a–d* shown in FIG. 1. Each of administrators 11*a–d* has a common line (not shown) just like that disclosed at 57 in FIG. 2. These common lines of administrators 11*a–d* are tapped into gate valves 24, 26, and 28 and steam ring 50 as shown in FIG. 1.

After being delivered into column 12 at points 50, 60, 62, 64, 66, 68, and 70 by the administrators, the steam (or steam plus cleaner) must be vented from the vessel. Most columns have a vent at the top that may be used for this purpose, such as vent 22 in FIG. 1. However, other vessels may, or may not have vents. Regardless, some means to vent effluent from the vessel must be provided. In some equipment, a bleeder valve or other alternative tap into the vessel may be used for this purpose. The bottom drain remains closed during the cleaning procedure.

The chosen vent should then be fluidly connected to the ventilation system of the refinery using techniques and equipment known to those skilled in the art. This connection should be consistent with a predetermined plan devised for dealing with the vented effluent. It is important that this particular plan complies with all state and local regulations. This can be done by any number of methods. Some examples of methods that have been used successfully are: (i) allowing the vapor to condense through the overhead circuit and tie into the flare so that it may be burned, (ii) opening an overhead vent to the atmosphere, or (iii) causing the effluent to flow into and through interconnected vessels. Of course, one skilled in the art will realize that other methods of managing the effluent are possible and are to be considered within the scope of the present invention.

It should be noted, that the user is given many options when selecting points of access to the vessel for either administration or venting purposes. Almost any kind of connection that grants access to the inside of the vessel may be used. Sometimes bleeders are used instead of gate valves.

Sometimes a combination of bleeders and process gauges might be used. In towers, the steam ring (also commonly referred to as stripping steam piping), in combination with other points of access, should almost always be used because of its lowermost positioning and distribution capabilities. Other kinds of vessel openings unnamed here, but known to those skilled in the art may be used as well. Thus, though the embodiments disclosed in this application shows the use of level gauge gate valves and the steam ring to tap into the vessel, the particular devices used to gain vaporous access to the vessel are not to be considered an essential or limiting feature of the present invention.

Once the steam and venting systems have been tapped in, the vessel is then preheated by injecting steam only into the column at all points of access selected. Column 12 should be continually vented throughout the preheating process. Again, the steam delivered should have temperatures of at about 330 degrees Fahrenheit. The injected steam increases internal temperatures within the vessel. These internal temperatures should be increased until they exceed 225 degrees Fahrenheit. Since this steam preheating and the subsequent injection process are both carried out at substantially atmospheric pressure while venting the vessel, it is important for the production facility to have a plan in effect for managing the vaporous, vented effluent as mentioned earlier. The preheating process will cause the development of some condensed water mixed with contaminants at the bottom of column 12. Therefore, in order to remove this mixture after the vessel has reached the 225 degree temperature, the steam is temporarily turned off so that the hydrocarbon-laced condensate may be drained from the vessel. Because draining the vessel may cause it to cool slightly, the steam should then be reactivated until the vessel reaches 225 degrees.

Once the vessel has been preheated as so, it is time to inject the cleaner into the already running steam. The amount of cleaner necessary is dependent on the total enclosed volume of the vessel and the nature and volume of contaminate.

The volume of the vessel can be calculated by multiplying the cross-sectional area of the vessel by the length. Typically, the ratio or amount of the cleaning agent injected is dependent on the total volume of the vessel. Most large vessels are in the shape of a cylinder. The volume of a cylinder is calculated by using the mathematical formula of:

$$V=\pi r^2 H$$

Where V is the total volume of the vessel in $ft^3$, pie ($\pi$) is approximately 3.14, $r^2$ is the square of the radius in feet, and H is the height of the vessel in feet.

Once total volume has been calculated, the preferred amount of cleaning agent to be injected into the vessel is computed using the ratio of one gallon of the cleaning agent per 23.05 $ft^3$ of vessel volume. Satisfactory results may be obtained, however, using ratios as low as one gallon of cleaning agent per 91 $ft^3$ of vessel volume and as high as one gallon of cleaning agent per 0.9 $ft^3$ of vessel volume. However, if the amount of contamination is greater than typical, ratios well above one gallon per 23.05 $ft^3$ of enclosed volume may be required.

Cleaner is pumped to each administrator 11*a–d* from 55-gallon drums and then delivered using administrators like the one shown in FIG. 2. The pneumatic pumps (not shown) used for the procedure require approximately nine minutes per 55-gallon drum to inject the cleaning agent. The steam will vaporize the cleaning agent and carry it into the equipment. For larger vessels, such as vessel 12 in FIG. 1, the drums should be pumped into various levels of the vessel simultaneously. The number of drums and location of entry into the vessel should be as follows:

| Location of Entry | % of Cleaning agent per location |
|---|---|
| Top ⅓ of Vessel | 10–20 |
| Middle ⅓ of Vessel | 20–30 |
| Bottom ⅓ of Vessel | 40–60 |

With respect to the column disclosed in FIG. 1, this would mean that 10–20 percent of the total cleaning agent would be pumped into upper portion 13 of vessel 12 by administrator 11*a,* 20–30 percent of the cleaning agent would be pumped into middle portion 14 by administrator 11*b*, and 40–60 percent of the cleaning agent would be pumped into the bottom portion of the vessel by administrators 11*c* and 11*d* combined.

Once the vaporized cleaning chemical enters into the vessel, two distinct cleaning actions take place simultaneously. First, the vaporous cleaning agent solublizes the light end hydrocarbons (benzene, $H_2S$, LEL, etc.) that are present on the inside of the vessel. Once solubilized by the vaporous cleaning agent, these light end materials are carried out of the vessel in vaporous form through the vent. The vapors coming out of the vent should be handled in accord with the plan set forth in advance. As already discussed, possible plans include, but are not limited to, (i) allowing the vapor to condense through the overhead circuit and then tie into the flare to be burned, (ii) opening an overhead vent to the atmosphere, or (iii) causing the effluent to flow into and through interconnected vessels.

The second cleaning action is more gradual. Due to the partial pressures of cleaning agent, some of its vapors will recondense into liquid upon contacting the cooler metal surfaces inside the vessel. These metal surfaces are usually heavily coated with petroleum residues and processing fluids. The kinetic energy generated when portions of the cleaning agent's vapors condense onto these metal surfaces (the transformation from a vapor phase to a liquid phase releases energy), along with the tremendous solvency strength of the formulation, allows the petroleum contaminants to be dissolved away from the metal surfaces inside the vessel. Once removed, these contaminants become detached from the metal and drip to the drain at the bottom of the vessel. Some contaminants, however, remain bound to the metal surfaces inside the vessel. These more stubborn contaminants, though still clinging to metal, are saturated by and subjected to the strong detergency, wetting, solubility, and water rinsing properties of the surfactant. This causes them to be loosened and easily soluble. Thus, they too are easily rinsed away.

After about one hour, the injection of cleaner into the vessel is stopped. Steam, however, continues to be injected.

Following the injection phase, the equipment is allowed to dwell for about one more hour at elevated temperature while steam is continually injected into the equipment. This dwell cycle allows the contaminants to further dissolve via continuous re-vaporization of the condensed cleaner.

After the dwell cycle, the steam injection is stopped, and the drain is opened to a post-processing or containment system. When the vessel is drained, liquid effluent comprising contaminate and residual cleaning agent is removed. The liquid effluent may be removed by carrying it out of the vessel directly to slop tanks. Once in the slop tanks, the effluent is easily post processed. The post processing is made easy because the cleaning agent is all natural, and thus, biodegradable. The effluent might also be passed directly through the post-processing equipment in the refinery, where it will be refined in the normal course of production. Because the cleaning agent included in the drained effluent is a naturally occurring hydrocarbon which does not contain any chelating agents, phosphates, silicates, or any chemicals that would cause problems with treatment facilities, it may be easily re-refined without harming the facility's equipment.

The next step is to water rinse the vessel. Water should be pumped into the vessel. For vessels that have trays or packed sections, the rinse water is pumped into the top and allowed to cascade downward. In other vessels, rinse water may be pumped into the bottom, floating the contaminant out the top, or a combination of rinse procedures is used. The rinsing should be continuous, and will eventually cool the vessel, condensing any remaining cleaning-agent-impregnated steam back into the liquid state. The resulting liquid will form a stable white macro-emulsion with water. The cleaning agent will also combine with the petroleum crude oil in the vessel and carry it out during the rinse cycle. Turbidity, or clarity, of the rinse water serves as an indicator of cleanliness. Initially the rinse effluent coming out of the vessel will be dark brown like chocolate milk. The chocolate milk appearance indicates the presence of water, the cleaning agent, and organic contaminants. As the water rinsing continues, the effluent will begin to look more like diluted white milk. A white milky appearance indicates the presence of water and the cleaning agent. The refinery operators should continue to water rinse until the effluent becomes clear. Clear rinse water indicates all of the cleaning agent has been rinsed out of the vessel, and that the rinse may be discontinued. Rinsing the vessel will commonly take 2 to 8 hours depending on the size of the vessel and how much cleaning agent was used during the process.

The cleaned vessel, its contaminants removed, will now operate at maximum efficiency.

It is important to note, that although the examples above suggest the use of multiple sources of steam, and multiple sources of cleaner, that single sources of steam or cleaner could be used. For example, multiple hoses could be drawn from one common source of steam. Likewise, cleaner could all be drawn from the same source.

Thus, there has been shown and described a method for cleaning a vessel in a refinery which fulfills all of the objects and advantages sought therefore. Many changes, modifications, variations, and other uses and applications of the subject invention will, however, become apparent to those skilled in the art after considering this specification together with the accompanying figures and claims. The same process, together with ensuing benefits are also applicable to similar equipment in unrelated industries (such as oil production, sugar, pulp and paper) where organic contaminants must be removed from process equipment so as to improve operating efficiencies. All such changes, modifications, variations and other uses and applications which do not depart from the spirit and scope of the invention are deemed to be covered by the invention which is limited only by the claims which follow.

What si claimed is:

1. A method of cleaning a vessel, comprising the steps of:

providing a steam source;

providing a surfactant source;

providing a solvent source which comprises terpene;

delivering steam from said steam source to said vessel;

introducing said terpene from said solvent source into the steam delivered to the vessel;

introducing a surfactant from said surfactant source into the steam delivered to the vessel;

removing hydrocarbon contaminants out of said vessel while said hydrocarbon contaminants are in a vaporized form as the steam, the surfactant, and terpene are delivered to the vessel;

introducing rinse water into the vessel; and removing rinse water from the vessel.

2. The method of claim 1 including the additional step of periodically observing the appearance of rinse water removed from the vessel to determine whether the vessel has been completely cleaned or not.

3. The method of claim 1 including the additional step of preheating the vessel with said steam prior to the introduction of terpene and the and surfactant.

4. The method of claim 1 wherein the surfactant comprises a linear alcohol ethoxylate (C12–C15) with an ethoxylated propoxylated end cap and a fatty alkanolamide.

5. The method of claim 1 wherein said surfactant comprises at least one of nonylphenol polyethoxylate, a straight chain linear alcohol ethoxylate, a linear alcohol ethoxylate with block copolymers of ethylene and propylene oxide, and diethanolamine.

6. The method of claim 1 wherein said terpene is a monocyclic saturated terpene.

7. The method of claim 1 wherein said terpene is a monocyclic unsaturated isoprenoid.

8. The method of claim 1 wherein said terpene is a bicyclic pine terpene.

9. The method of claim 1 wherein the surfactant and terpene introduced into said steam by joining said steam, surfactant, and solvent sources.

10. The method of claim 1 wherein said vessel is a tower.

11. The method of claim 1 wherein said vessel is a piece of equipment in a refinery.

12. The method of claim 1 wherein the step of removing said hydrocarbon contaminants further comprises the step of:

venting the the hydrocarbon contaminants in a vaporized form;

one of the atmosphere, a flare, and an interconnected vessel.

13. The method of claim 6 wherein said monocyclic saturated terpene is para-menthane.

14. The method of claim 9 wherein said joining is accomplished using a T-fitting.

* * * * *